US008882549B2

(12) United States Patent
Suzuki

(10) Patent No.: US 8,882,549 B2
(45) Date of Patent: Nov. 11, 2014

(54) CONNECTING STRUCTURE FOR AN ALUMINUM ELECTRIC CONDUCTOR AND A CONNECTOR

(75) Inventor: Mitsuru Suzuki, Yokohama (JP)

(73) Assignee: PL Co., Ltd., Tokyo (JP)

( * ) Notice: Subject to any disclaimer, the term of this patent is extended or adjusted under 35 U.S.C. 154(b) by 125 days.

(21) Appl. No.: 13/574,020

(22) PCT Filed: Nov. 29, 2010

(86) PCT No.: PCT/JP2010/006933

§ 371 (c)(1),
(2), (4) Date: Jul. 19, 2012

(87) PCT Pub. No.: WO2011/111138

PCT Pub. Date: Sep. 15, 2011

(65) Prior Publication Data

US 2012/0295496 A1 Nov. 22, 2012

(30) Foreign Application Priority Data

Mar. 11, 2010 (JP) ..... 2010-054193

(51) Int. Cl.

| | |
|---|---|
| ***H01R 4/10*** | (2006.01) |
| ***H01R 4/62*** | (2006.01) |
| ***H01R 4/18*** | (2006.01) |
| ***H01R 4/20*** | (2006.01) |

(52) U.S. Cl.

CPC ..... *H01R 4/203* (2013.01); *H01R 4/62* (2013.01); *H01R 4/188* (2013.01)

USPC ..... 439/882

(58) Field of Classification Search

USPC ..... 439/882, 442, 423, 877, 884

See application file for complete search history.

(56) References Cited

U.S. PATENT DOCUMENTS

| | | | | |
|---|---|---|---|---|
| 2,604,508 A | | 6/1952 | Bergan | |
| 5,888,107 A | * | 3/1999 | Seymour et al. | 439/891 |
| 6,086,413 A | * | 7/2000 | Karasik et al. | 439/516 |

(Continued)

FOREIGN PATENT DOCUMENTS

| | | |
|---|---|---|
| JP | 2003-243057 A | 8/2003 |
| JP | 2009-283458 A | 12/2009 |

(Continued)

OTHER PUBLICATIONS

State Intellectual Property Office of People's Republic of China, Beijing, P.R. China, Notification of the First Office Action and English translation of First Office Action, Jul. 30, 2014.

*Primary Examiner* — Jean F Duverne
(74) *Attorney, Agent, or Firm* — Hammer & Associates, P.C.

(57) ABSTRACT

To prevent electric resistance between an electric conductor and a coupling part made of aluminum from becoming larger by stopping cold flow in an aluminum electric conductor, an end section of the aluminum electric conductor is crimped at a crimping section of the coupling part, multiple projections are formed in the crimping section, each of the projections has a truncated quadrangular pyramid shape and also has four inclined planes, the projections are pressed into the surface of the aluminum electric conductor but bases of the projections are not inserted, a distorted region is formed on the surface of the aluminum electric conductor along the inclined plane, thereby forming multiple independent regions, each surrounded by distorted regions, on the surface of the aluminum electric wire.

17 Claims, 7 Drawing Sheets

(56) References Cited

U.S. PATENT DOCUMENTS

| | | | | |
|---|---|---|---|---|
| 6,290,556 | B1 * | 9/2001 | Howland et al. | 439/879 |
| 6,334,798 | B1 * | 1/2002 | Ushijima et al. | 439/879 |
| 7,722,416 | B2 * | 5/2010 | Gump et al. | 439/879 |
| 8,187,043 | B2 * | 5/2012 | Kumakura et al. | 439/882 |
| 8,221,171 | B2 * | 7/2012 | Ono et al. | 439/877 |
| 8,303,354 | B2 * | 11/2012 | Ootsuka et al. | 439/877 |
| 8,303,355 | B2 * | 11/2012 | Ono et al. | 439/877 |
| 8,333,624 | B2 * | 12/2012 | Kakuta | 439/877 |
| 2010/0206631 | A1 * | 8/2010 | Peters et al. | 174/77 R |
| 2010/0230160 | A1 | 9/2010 | Ono et al. | |

FOREIGN PATENT DOCUMENTS

| | | | |
|---|---|---|---|
| WO | WO 97/16867 | A1 | 5/1997 |
| WO | WO 2009/057735 | A1 | 5/2009 |
| WO | WO 2009/128344 | A1 | 10/2009 |

* cited by examiner

CONNECTING STRUCTURE FOR AN ALUMINUM ELECTRIC CONDUCTOR AND A CONNECTOR

TECHNICAL FIELD

The present invention relates to a connecting structure for connecting an aluminum electric conductor to a coupling part and also relates to a connector used for the connecting structure.

BACKGROUND ART

According to a connecting structure of the conventional aluminum electric wire, an end section of an aluminum electric wire is crimped at a crimping section of a connector, as shown in JP 2009-283458A.

SUMMARY OF INVENTION

Problems to be Solved

With the connecting structure of the aluminum electric wire, stress acting on a crimping section of the aluminum electric wire decreases due to cold flows, which are an inherent feature of the aluminum material, as time elapses. As a result, the crimping force between the aluminum electric wire and the crimping section becomes smaller as time elapses, and thus electric resistance between the aluminum electric wire and the crimping section becomes larger.

An object of the present invention is to prevent electric resistance between an electric conductor made of aluminum and a coupling part from becoming larger.

Solution to the Problem

To attain this object, multiple projections, each having an inclined plane, are formed in a coupling part. Multiple projections are pressed into a surface of an aluminum electric conductor, and multiple distorted regions are formed in the surface of the aluminum electric conductor along respective inclined planes, according to the present invention.

Advantageous Effect of the Invention

According to a connecting structure of an aluminum electric conductor of the present invention, multiple distorted regions are formed along inclined planes of each projection section, and the cold flow from each of the distorted regions arises mainly in the direction perpendicular to the corresponding inclined plane, and the cold flow coming from a part of one distorted region may thus be stopped by the other distorted regions or the other regions in the same distorted region. As a result, decrease in stress on each of the distorted regions due to cold flow may be controlled, thereby preventing decrease in the adhesion force between the inclined plane of each projection section and corresponding distorted region. This leads to a prevention of increase in electric resistance between the electric conductor made of aluminum and the coupling part.

BRIEF DESCRIPTION OF THE DRAWINGS

FIG. 1 view a connecting structure of an aluminum electric wire according to an embodiment of the present invention; wherein

FIG. 4 view a part of the connector shown in FIG. 3; wherein FIGS. 4A to 4C are views of a main body, and FIGS. 4D to 4F are views of a projection component; wherein FIGS. 4A and 4D are plan views, FIGS. 4B and 4E are front views, FIG. 4C is a left-hand side view, and FIG. 4F is a view of the projection component bent into a cylindrical form.

FIG. 5 view parts comprising a connector according to another embodiment of the present invention; wherein FIGS. 5E to 5H are views of an anchor; wherein FIGS. 5A and 5E are plan views, FIGS. 5B and 5F are left-hand side views, FIGS. 5C and 5G are front views, and FIGS. 5D and 5H are right-hand side views.

FIG. 6 is a view of how to connect the aluminum electric wire to the connector shown in FIG. 5, and FIG. 7 view a connector according to another embodiment of the present invention; wherein

DESCRIPTION OF EMBODIMENTS

Figure 1A:
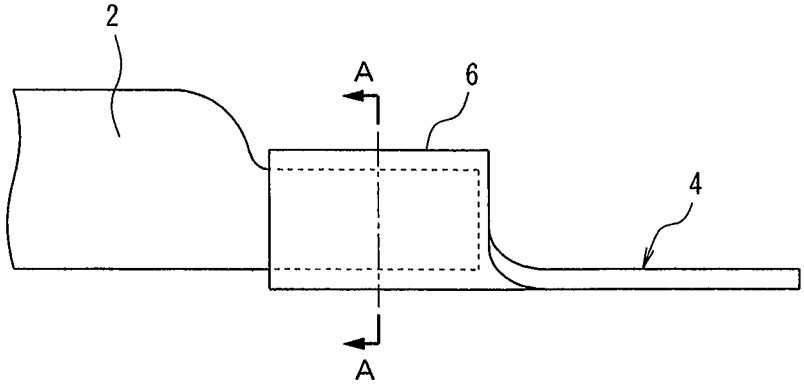
FIG. 1A is a view of the connecting structure of the aluminum electric wire.
Figure 1B:
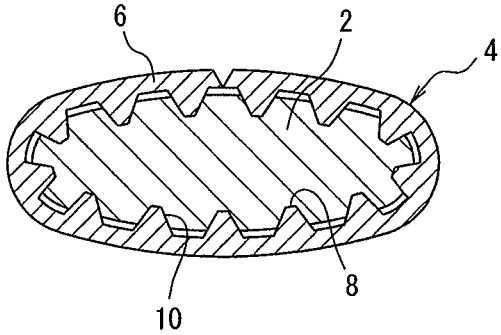
FIG. 1B is an enlarged cross-sectional view cut along an A-A line of FIG. 1A.
Figure 1C:
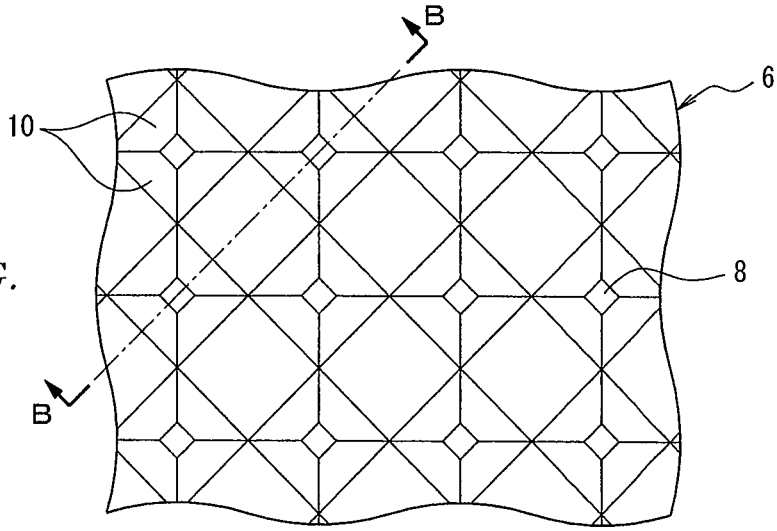
FIG. 1C is a view of a part of a crimping section of a connector not yet deformed used for the connecting structure of the aluminum electric wire shown in FIGS. 1A and 1B.
Figure 1D:
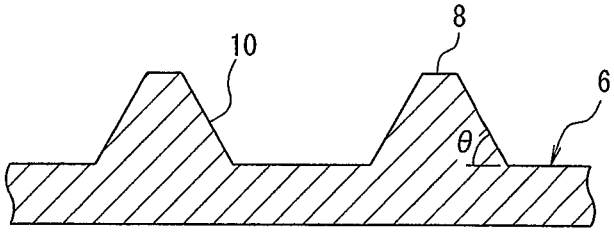
FIG. 1D is an enlarged cross-sectional view cut along a B-B line of FIG. 1C.
Figure 2:
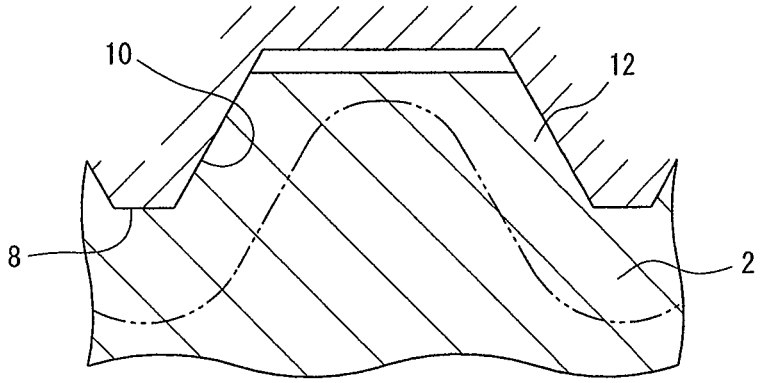
FIG. 2 is a cross-sectional view of a part of the connecting structure of the aluminum electric wire shown in FIG. 1.

According to a connecting structure of an aluminum electric wire of an embodiment of the present invention, an end section of an aluminum electric wire 2, which is a single solid wire and a crimping section 6 of a connector 4, crimped together, as shown in FIGS. 1 and 2. Multiple projections 8 (projection sections) are formed in a crimping section 6. Each of the projections 8 has a truncated quadrangular pyramid shape and also has four inclined planes 10 as four sides thereof. Moreover, an angle of a ridgeline for the projections 8 to the surface of the crimping section 6 is 60 degrees, and an angle of gradient θ of each of the inclined planes 10 is 60 degrees, as shown in FIG. 1D. The projections 8 are pressed into the surface as a portion of the aluminum electric wire 2 with their bases being left un-inserted, and a distorted region 12 is formed in the surface of the aluminum electric wire 2 along each of the inclined planes 10. Multiple independent regions, each surrounded by corresponding enclosing distorted regions, are formed in the surface of the aluminum electric wire 2. That is, a distorted region 12 continuously extending in the horizontal direction in FIG. 2 is formed within an area surrounded by four protrusions 8 in the surface of the aluminum electric wire 2, and multiple independent regions, each surrounded by a continuous connected extending distorted regions 12, are formed. Moreover, in the area surrounded by four projections 8 on the surface of the aluminum electric wire 2, volume of the distorted regions 12 is larger than that of the other regions.

According to such a connecting structure of the aluminum electric wire, multiple independent regions, each surrounded by corresponding distorted regions 12, are formed in the surface of the aluminum electric wire 2; wherein every portion of each of the distorted regions 12 faces corresponding other portion of the distorted regions 12. Therefore, since cold flow coming from a portion of each of the distorted regions 12 may be suppressed by the other portions thereof, cold flow can certainly be prevented. As a result, stress on the distorted regions 12 due to cold flow may be suppressed, and thereby preventing decrease in the crimping force (adhesion force) between each inclined plane 10 of the projections 8 and corresponding distorted region 12 of the aluminum electric wire 2. This leads to the prevention of electric resistance between the aluminum electric wire 2 and the crimping section 6 of the connector 2 from becoming larger.

Figure 3A:
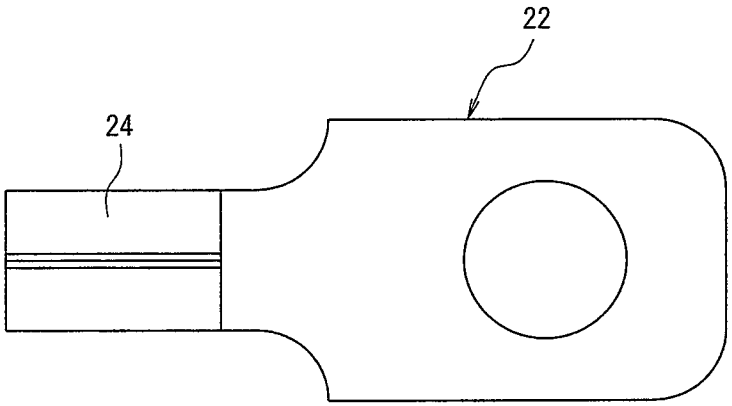
FIG. 3 view a connector according to an embodiment of the present invention; wherein FIGS. 3A, 3 B, and 3C are a front view, a plan view, and a left-hand side view, respectively.
Figure 3B:
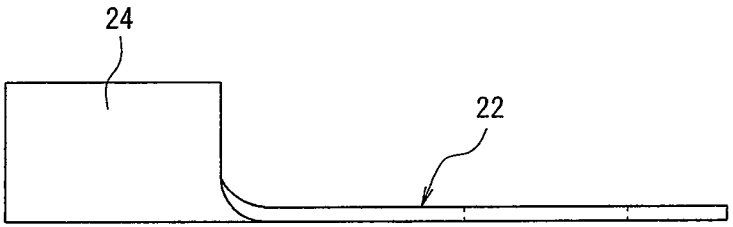
Figure 3C:
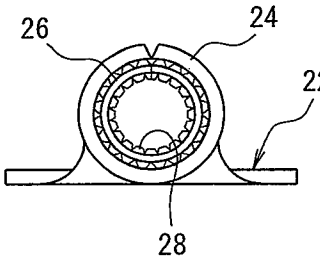
Figures 4A, 4B, 4C, 4D, 4E, 4F:
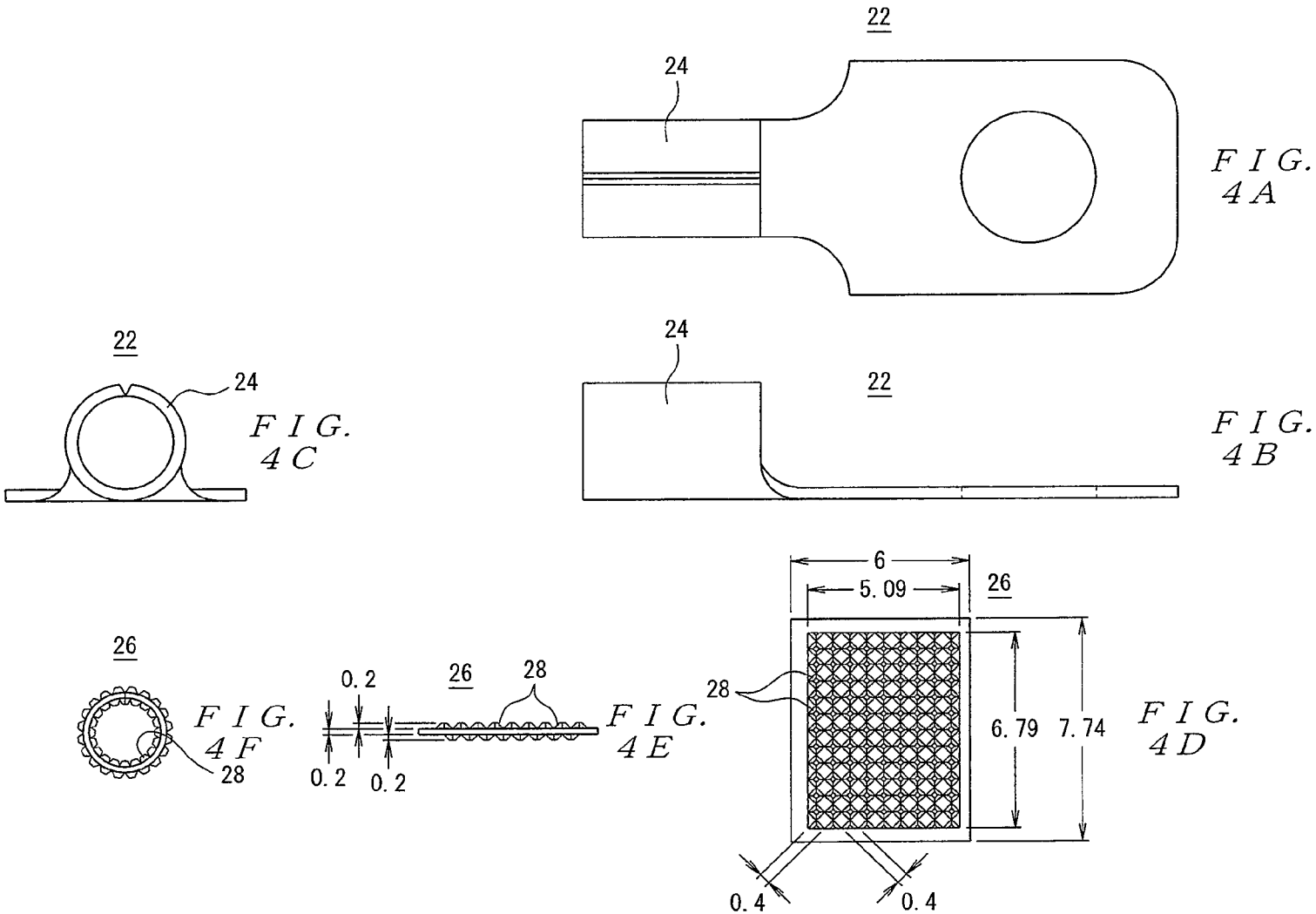
Figure 5A:
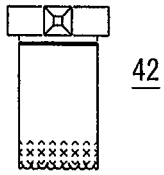
FIGS. 5A to 5D are views of a post.
Figure 5B:
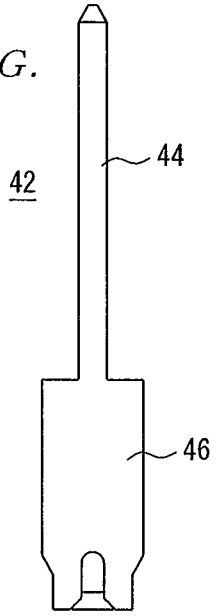
Figure 5C:
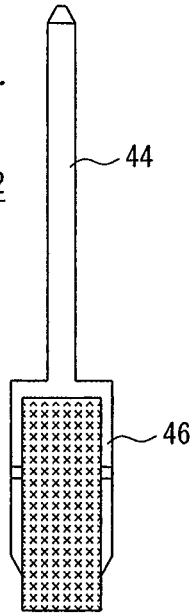
Figure 5D:
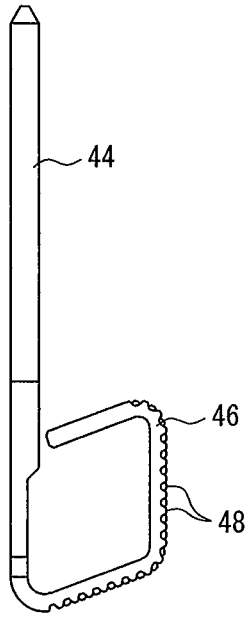
Figure 5E:
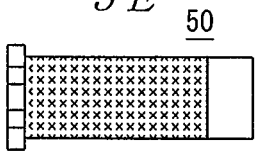
Figure 5F:
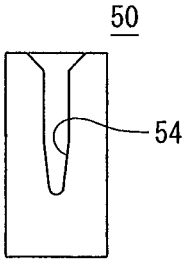
Figure 5G:
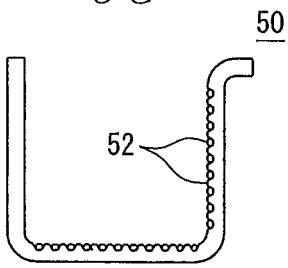
Figure 5H:
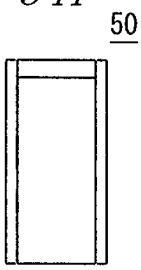

With a connector according to an embodiment of the present invention, a crimping section 24 is formed in a main body 22 made of copper, as shown in FIGS. 3 and 4. A projection component 26 as a projection bearing member made of copper is fixed to the crimping section 24 by brazing. Multiple projections 28 (projection sections) are formed on a surface of the projection component 26. Each of the projections 28 has a truncated quadrangular pyramid shape and also has four inclined planes. In FIG. 4E, angle of a ridgeline for the projections 28 to the surface of the projection component 26 is 60 degrees. As shown in FIG. 4D, dimensions of the portion where the projections 28 are formed are 6.79 mm in the vertical direction on the drawing and 5.09 mm in the horizontal direction on the same. The dimension of the bottom of each of the projections 28 is 0.4 mm and height of each of the projections 28 is 0.2 mm.

With this connector, an end section of the aluminum electric wire 2 is inserted into the almost-cylindrically-shaped crimping section 24, and the end section of the aluminum electric wire 2 and the crimping section 24 are then crimped together, thereby connecting the aluminum electric wire 2 to the connector. With the aluminum electric wire 2 and the connector being connected, the entire peripheral surface of the end section of the aluminum electric wire 2 is covered by the projection component 26.

With such a connector, the projections 28 are pressed into the entire peripheral surface of the end section of the aluminum electric wire 2, with the aluminum electric wire 2 and the connector being connected. Since multiple independent regions, each surrounded by enclosing distorted regions, are formed in the surface of the aluminum electric wire 2, cold flow may certainly be stopped, thereby securely preventing electric resistance between the aluminum electric wire 2 and the crimping section 24 of the connector from becoming larger.

In a connector, according to another embodiment of the present invention, a post 42 made of copper has a handle 44 and a crimping section 46 bent into a quadrangular shape, as shown in FIG. 5. Projections 48 (projection sections) are formed on the crimping section 46. Each of the projections 48 has a truncated quadrangular pyramid shape and also has four inclined planes. Angle of a ridgeline for the projections 48 to the surface of the crimping section 46 is 60 degrees. An anchor 50 made of copper is formed by bending a board into an approximately U-shape, and projections 52 (projection sections) are formed on the inner surface of the anchor 50. Each of the projections 52 has a truncated quadrangular pyramid shape and also has four inclined planes. Angle of a ridgeline for the projections 52 to the surface of the anchor 50 is 60 degrees. A groove 54 is formed in the anchor 50.

Figures 6A, 6B, 6C, 6D:
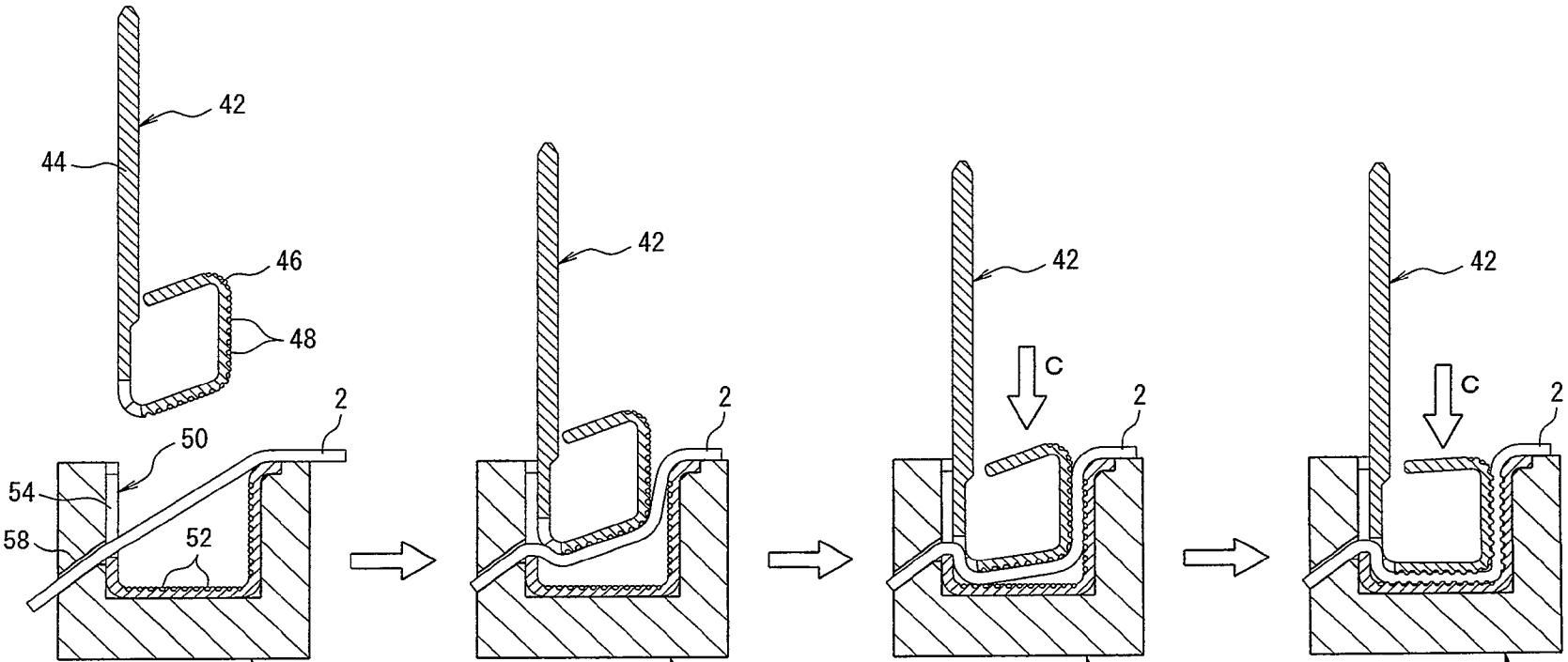

A connecting method for the connector and the aluminum electric wire shown in FIG. 5 is explained below with reference to FIG. 6. First, the anchor 50 is placed in a concave base 56 having a hole 58, and the end section of the aluminum electric wire 2 is put through the groove 54 and the hole 58, as shown in FIG. 6A. Next, the crimping section 46 is placed in the anchor 50 by descending the post 42, as shown in FIG. 6B. Afterwards, the crimping section 46 is deformed by pushing the crimping section 46 in the direction of an arrow C, as shown in FIG. 6C. Next, the aluminum electric wire 2 and the connector are connected by crimping the end section of the aluminum electric wire 2 between the crimping section 46 and the anchor 50, as shown in FIG. 6D. The end section of the aluminum electric wire 2 is sandwiched between the crimping section 46 and the anchor 50, with the aluminum electric wire 2 and the connector being connected.

With such a connector, the projections 48 and 52 are pressed into the surface of the end section of the aluminum electric wire 2, with the aluminum electric wire 2 and the connector being connected. Since multiple independent regions, each surrounded by corresponding distorted regions, are formed in the surface of the aluminum electric wire 2, cold flow may certainly be stopped, and thereby preventing electric resistance among the aluminum electric wire 2, the crimping section 46 of the connector, and the anchor 50 from becoming larger.

A connector according to another embodiment of the present invention has a 'insulation displacing' pressure contact section 64 made of copper and formed in a main body 62 made of copper, as shown in FIG. 7. The pressure contact section 64 has four tabular sections 66, which are made by bending one board, and each of the tabular sections 66 has a groove 68. The center of the groove 68 is included in a plane perpendicular to each of the tabular sections 66, and the width of each groove 68 (dimension in the horizontal direction of FIG. 7C) is the same. Each of edges defining the groove 68 in each tabular section 66 has an inclined plane 70, and the angle of the inclined plane 70 along the vertical axis of FIG. 7E, or an angle of gradient thereof is 60 degrees.

Figure 7A:
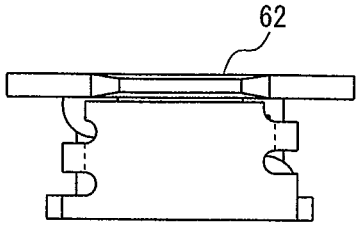
FIGS. 7A, 7B, 7C, 7D, and 7E are a plan view, a front view, a bottom view, a right side view, and a cross-sectional view cut along a D-D line of FIG. 7D, respectively.
Figure 7B:
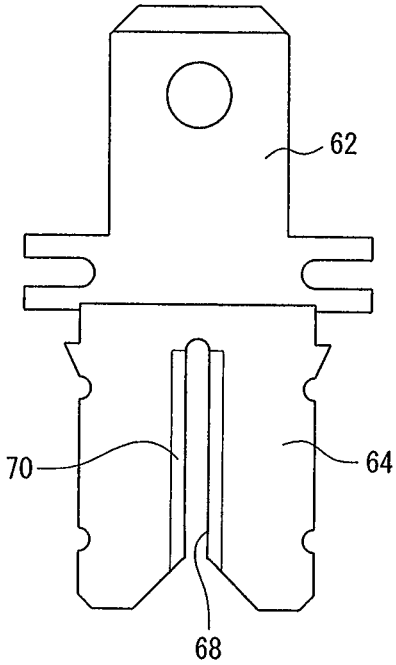
Figure 7D:
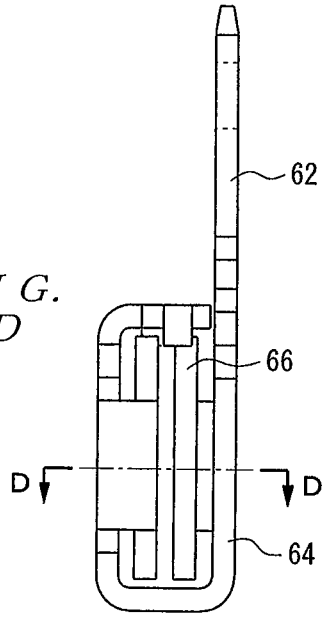
Figure 7C:
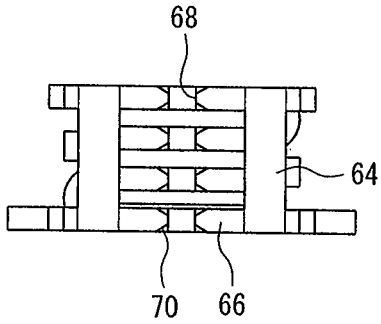
Figure 7E:
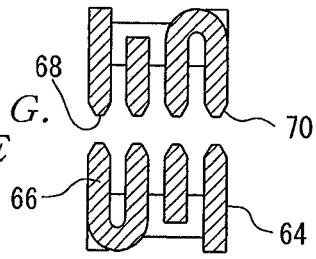

With this connector, the aluminum electric wire 2 and the connector are connected by inserting the end section of the aluminum electric wire 2 into the groove 68 (projection section) from a lower position of FIG. 7B and then by pressure contact edges defining the groove 68 of each tabular section 66 and the end section of the aluminum electric wire 2.

With such a connector, each of edges defining the groove 68 of each tabular section 66 is pressed into the surface of the aluminum electric wire 2, with the aluminum electric wire 2 and the connector being connected. A distorted region is formed in the surface of the aluminum electric wire 2 along an inclined plane 70 of the groove 68 of each tabular section 66, and multiple opposing regions where respective distorted regions oppose each other are formed in the surface of the aluminum electric wire 2. Therefore, since cold flow from two opposing distorted regions may be stopped by the other distorted regions, decrease in contact pressure (adhesion force) due to cold flow between an inclined plane 70 at each of edges defining the groove 68 of each tabular section 66 and corresponding distorted region may be prevented. This ends up in preventing electric resistance between the aluminum electric wire 2 and the pressure contact section 64 of the connector from becoming larger.

Note that the present invention is not limited to the aforementioned embodiments and should include the case where an independent regions and an opposing regions are not formed in the surface of the aluminum electric conductor naturally.

Moreover, while the case where the aluminum electric conductor is the aluminum electric wire 2 according to the aforementioned embodiments is explained, the present invention is applicable to the case where the aluminum electric conductor is plate-like (tabular) etc.

Moreover, while the angle of gradient of the inclined plane of each projection section (projections 8, 28, 48, and 52, and each of edges defining the groove 68 of each tabular section 66) is set to 60 degrees according to the aforementioned embodiments, it is desirable that an angle of gradient of each of the inclined planes of each projection section is set to 45 to 75 degrees, more preferably 55 to 65 degrees. In this case, when an angle of gradient of each inclined plane of each projection section is set to 45 degrees or more, more preferably 55 degrees or more, cold flows may be stopped more effectively by the distorted regions. Furthermore, when an angle of gradient of each inclined plane of each projection section is set to 75 degrees or less, more preferably 65 degrees or less, the distorted region along each inclined plane may be formed thicker, thereby preventing electric resistance between the aluminum electric conductor of the aluminum electric wire 2 or the like and the coupling part, such as a connector, from becoming larger.

Moreover, it is desirable to make distortion of each distorted region fall between 16% and 32%. In this case, since stress on aluminum materials is almost constant irrespective of distortion when the distortion is 16 to 32%, decrease in adhesion force between each inclined plane of each projection section and corresponding distorted region may be prevented sufficiently. Therefore, electric resistance between the aluminum solid conductor of the aluminum electric wire 2 or the like and the coupling part, such as a connector, may be prevented from becoming larger sufficiently.

Moreover, when the aluminum electric conductor is an aluminum electric wire, it is desirable that distance between the centers of respective neighboring projection sections be set to 0.25 to 1.25 times the diameter of the aluminum electric wire. When distance between the centers of respective neighboring projection sections is set to 0.25 or greater times the diameter of the aluminum electric wire, manufacturing of coupling parts, such as a connector, is facilitated. When distance between the centers of respective neighboring projection sections is set to 1.25 or less times the diameter of the aluminum electric wire, increase in length of a coupling part, such as a connector, in the axial direction of the aluminum electric wire may be prevented from becoming larger.

While the case where the pressure contact section 32 has four tabular sections 33 according to the aforementioned embodiment shown in FIG. 7 is explained, three or more tabular sections, or five or more tabular sections may be formed in the pressure contact section.

INDUSTRIAL APPLICABILITY

The present invention may be applicable to the case of connecting an aluminum electric conductor, such as an aluminum electric wire, to a coupling part such as a connector made of copper etc.

The invention claimed is:

1. A connecting structure for connecting a conductor made of aluminum and a coupling part with each other, the connecting structure comprising:

a coupling part provided with a set of projections having inclined sides;

a solid conductor made of aluminum having the projections pressed into a surface portion thereof, and a set of distorted regions continuously formed along the inclined sides in the surface portion of the solid conductor for stopping cold flows of aluminum.

2. The connecting structure according to claim 1, wherein the set of distorted regions comprises distorted regions enclosing a region in the surface portion of the solid conductor.

3. The connecting structure according to claim 1, wherein the set of distorted regions comprises opposite distorted regions at a region in the surface portion of the solid conductor.

4. The connecting structure according to claim 1, wherein the inclined sides have inclination angles within a range of 45 to 75 degrees.

5. The connecting structure according to claim 1, wherein the set of distorted regions has degrees of distortion within a range of 16 to 32%.

6. The connecting structure according to claim 1, wherein the solid conductor comprises a single solid conductor of an aluminum electric wire, and the projections have center-to-center distances thereof within a range of 0.25 to 1.25 times a diameter of the single solid conductor.

7. A connector for connecting a conductor made of aluminum, comprising:

a connector body;

a crimping section provided at the connector body to be crimped on a solid conductor made of alumina;

a projection bearing member fixed to the crimping section; and a set of projections projecting from the projection bearing member, the projections having inclined sides, the projections being configured to be pressed into a surface portion of the solid conductor, to have a set of distorted regions continuously formed along the inclined sides in the surface portion for stopping cold flows of aluminum.

8. The connector according to claim 7, wherein the projection bearing member is brazed to fix to the crimping section.

9. The connector according to claim 7, wherein the projection bearing member is made of copper.

10. A connector for connecting a conductor made of aluminum, comprising:

a post member comprising a crimping section to be crimped on a solid conductor made of alumina;

a set of first projections provided at the crimping section, the first projections having first inclined sides, the first projections being configured to be pressed into a first surface portion of the solid conductor, to have a set of distorted regions continuously formed along the first inclined sides in the first surface portion for stopping cold flows of aluminum;

an anchor member configured for the crimping section of the post member to be fit therein; and a set of second projections provided at an inside of the anchor member, the second projections having second inclined sides, the second projections being configured to be pressed into a second surface portion of the solid conductor, to have a set of distorted regions continuously formed along the second inclined sides in the second surface portion for stopping cold flows of aluminum.

11. The connector according to claim 10, wherein the crimping section of the post member is formed in a rectangular shape.

12. The connector according to claim 10, wherein the anchor member comprises a tabular member flexed in a U shape.

13. The connector according to claim 10, wherein the post member is made of copper.

14. The connector according to claim 10, wherein the anchor member is made of copper.

15. A connector for connecting a conductor made of aluminum, comprising:

a connector body; and a pressure contact section provided at the connector body, the pressure contact section comprising:

three or more tabular portions; and a groove defined by edges of the tabular portions, the edges of the tabular portions respectively comprising projections having inclined sides, the projections being configured to be pressed into a surface portion of a solid conductor made of aluminum and inserted in the groove, to have a set of distorted regions continuously formed along the inclined sides in the surface portion for stopping cold flows of aluminum.

16. The connector according to claim 15, wherein a single tabular member is flexed to provide the three or more tabular portions.

17. The connector according to claim 15, wherein the pressure contact section is made of copper.

* * * * *